US005677673A

United States Patent [19]

Kipnis

[11] Patent Number: 5,677,673

[45] Date of Patent: Oct. 14, 1997

[54] APPARATUS FOR LOCATING A PLURALITY OF OBJECTS

[76] Inventor: Alan R. Kipnis, 20529 Dumont St., Woodland Hills, Calif. 91364

[21] Appl. No.: 614,677

[22] Filed: Mar. 13, 1996

[51] Int. Cl.[6] ..... G08B 1/08

[52] U.S. Cl. ..... 340/539; 340/571; 340/572; 340/825.36; 340/825.49; 340/691; 367/197; 367/199

[58] Field of Search ..... 340/571, 524, 340/572, 573, 825.36, 825.03, 825.49, 691; 367/117, 197, 199

[56] References Cited

U.S. PATENT DOCUMENTS

| | | | |
|---|---|---|---|
| 4,476,469 | 10/1984 | Lander | 340/825.49 |
| 4,935,907 | 6/1990 | Friedman | 367/118 |
| 5,204,657 | 4/1993 | Prosser et al. | 340/568 |
| 5,410,326 | 4/1995 | Goldstein | 348/134 |

*Primary Examiner*—Jeffery Hofsass
*Assistant Examiner*—Daryl C. Pope

[57] ABSTRACT

An apparatus for locating a plurality of objects including a plurality of receiver units. Each receiver includes a receiver housing with a first pile fastener secured to a bottom surface thereof for allowing coupling with a second pile fastener situated on an entity. A speaker is situated on the top surface of each receiver housing for transmitting an audio signal. Also included is a receiver mechanism situated within the receiver housing and connected to the speaker. Each receiver mechanism is adapted to transmit a unique audio signal via the speaker thereof upon the receipt of a unique activation signal. The second major component is a transmitter unit comprising a plurality of push button switches situated on the front face thereof. Finally, a transmitter mechanism is situated within the transmitter housing and coupled to the push button switches. The transmitter mechanism is adapted to transmit a unique activation signal corresponding to a receiver unit upon the continuous depression of a corresponding push button switch.

3 Claims, 4 Drawing Sheets

APPARATUS FOR LOCATING A PLURALITY OF OBJECTS

BACKGROUND OF THE INVENTION

1. Field of the Invention

The present invention relates to an apparatus for locating a plurality of objects and more particularly pertains to affording a unique method of identifying the location of a plurality of missing items.

2. Description of the Prior Art

The use of locating devices is known in the prior art. More specifically, locating devices heretofore devised and utilized for the purpose of locating lost items are known to consist basically of familiar, expected and obvious structural configurations, notwithstanding the myriad of designs encompassed by the crowded prior art which have been developed for the fulfillment of countless objectives and requirements.

By way of example, the prior art discloses in U.S. Pat. No. 4,476,469 to Lander a locator means for assisting and locating an object comprising a hand held searcher comprising a short range signal transmitter. U.S. Pat. No. 5,294,915 to Owen discloses a means for locating a remote control device, wherein the device is hard wired into the circuitry of the appliance. U.S. Pat. No. Design 339,757 to Feeney discloses the ornamental design for a combined transmitter and receiver for a child locator. U.S. Pat. No. 5,337,041 to Friedman; U.S. Pat. No. 4,924,219 to Sato; and U.S. Pat. No. 4,797,671 to Toal, Jr. are provided as being of general interest.

In this respect, the apparatus for locating a plurality of objects according to the present invention substantially departs from the conventional concepts and designs of the prior art, and in so doing provides an apparatus primarily developed for the purpose of affording a unique method of identifying the location of a plurality of missing items.

Therefore, it can be appreciated that there exists a continuing need for a new and improved apparatus for locating a plurality of objects which can be used for affording a unique method of identifying the location of a plurality of missing items. In this regard, the present invention substantially fulfills this need.

SUMMARY OF THE INVENTION

In view of the foregoing disadvantages inherent in the known types of locating devices now present in the prior art, the present invention provides an improved apparatus for locating a plurality of objects. As such, the general purpose of the present invention, which will be described subsequently in greater detail, is to provide a new and improved apparatus for locating a plurality of objects which has all the advantages of the prior art and none of the disadvantages.

To attain this, the present invention essentially comprises a plurality of receiver units each including a disk-shaped receiver housing. Each receiver housing has a first pile fastener secured to a bottom surface thereof for allowing coupling with a second pile fastener situated on an entity. For identification purposes, indicia indicative of the entity attached to the receiver housing is imprinted on a top surface thereof. Also included is a speaker situated on the top surface of the receiver housing for transmitting an audio signal. A receiver mechanism is situated within the receiver housing and connected to the speaker. The receiver mechanism of each receiver unit is adapted to transmit a unique audio signal via the speaker thereof upon the receipt of a unique activation signal. The second major component includes a transmitter unit comprising a transmitter housing with a generally rectangular configuration. The transmitter housing has a front face, a rear face, and a periphery formed therebetween defining an interior space. A plurality of push button switches are situated on the front face of the housing in a linearly aligned vertical configuration adjacent to the periphery thereof. Each push button is adapted to actuate upon the depression thereof. Further included is a single throw double pole selection switch situated on the front face of the housing. In use, the selection switch has a first orientation and a second orientation. A plurality of transparent sleeves are each positioned on the front face of the housing adjacent to a corresponding push button switch. For inserting within each of the transparent sleeves, a plurality of labels comprising a slip of paper are included with indicia indicative of an entity imprinted thereon. Finally, a transmitter mechanism is situated within the transmitter housing and coupled to the push button switches and selection switch. When the selection switch is in the first orientation thereof, the transmitter mechanism is adapted to transmit a unique activation signal corresponding to a receiver unit upon the continuous depression of a corresponding push button switch. In such a mode of operation, one of the receiver units transmits a unique audio signal solely while the push button switch is depressed. In another mode of operation wherein the selection switch is in the second orientation thereof, the transmitter mechanism is adapted to transmit a sustained unique activation signal corresponding to one of the receiver units upon a first depression of a corresponding button switch. Also in this mode, the user may effect cessation of the sustained activation signal by depressing the corresponding push button switch a second time. In the latter mode of operation, one of the receiver units transmits a continuous unique audio signal without the need for a user to continuously depress the corresponding push button switch.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved apparatus for locating a plurality of objects which has all the advantages of the prior art locating devices and none of the disadvantages.

It is another object of the present invention to provide a new and improved apparatus for locating a plurality of objects which may be easily and efficiently manufactured and marketed.

It is a further object of the present invention to provide a new and improved apparatus for locating a plurality of objects which is of a durable and reliable construction.

An even further object of the present invention is to provide a new and improved apparatus for locating a plurality of objects which is susceptible of a low cost of manufacture with regard to both materials and labor, and which accordingly is then susceptible of low prices of sale to the consuming public, thereby making such apparatus for locating a plurality of objects economically available to the buying public.

Still yet another object of the present invention is to provide a new and improved apparatus for locating a plurality of objects which provides in the apparatuses and methods of the prior art some of the advantages thereof, while simultaneously overcoming some of the disadvantages normally associated therewith.

Still another object of the present invention is to afford a unique method of identifying the location of a plurality of missing items.

Lastly, it is an object of the present invention to provide a new and improved apparatus for locating a plurality of objects including a plurality of receiver units. Each receiver includes a receiver housing with a first pile fastener secured to a bottom surface thereof for allowing coupling with a second pile fastener situated on an entity. A speaker is situated on the top surface of each receiver housing for transmitting an audio signal. Also included is a receiver mechanism situated within the receiver housing and connected to the speaker. Each receiver mechanism is adapted to transmit a unique audio signal via the speaker thereof upon the receipt of a unique activation signal. The second major component is a transmitter unit comprising a plurality of push button switches situated on the front face thereof. Finally, a transmitter mechanism is situated within the transmitter housing and coupled to the push button switches. The transmitter mechanism is adapted to transmit a unique activation signal corresponding to a receiver unit upon the continuous depression of a corresponding push button switch.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
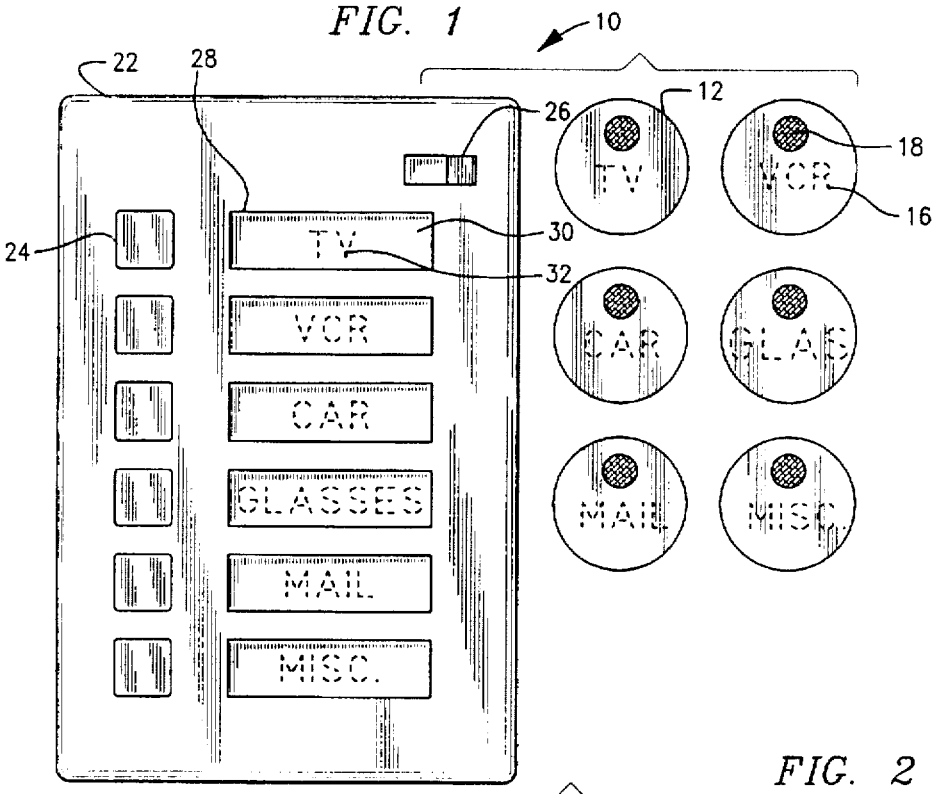
FIG. 1 is a plan illustration of the preferred embodiment of the apparatus for locating a plurality of objects constructed in accordance with the principles of the present invention.
Figure 2:
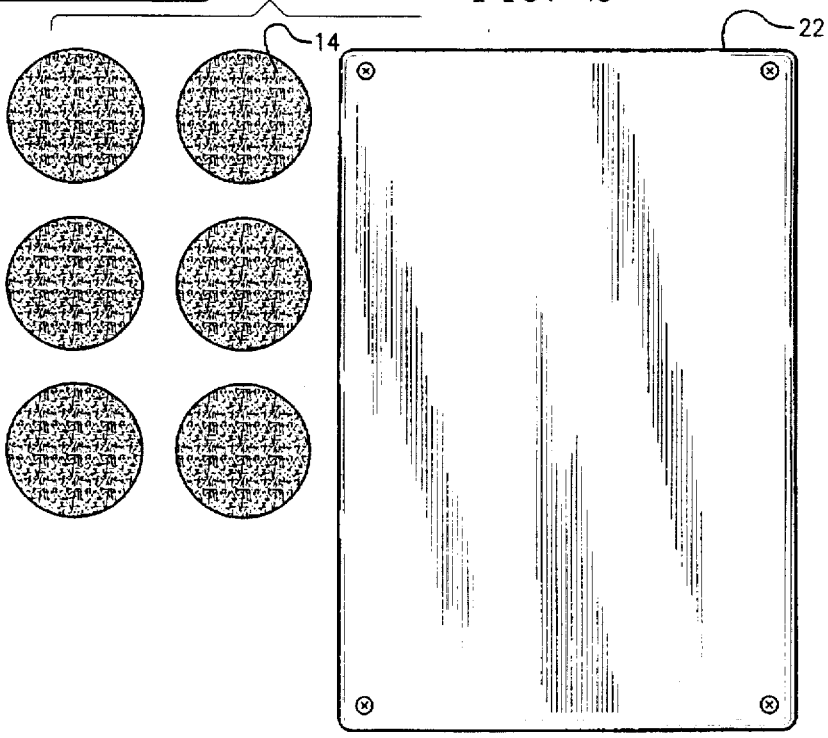
FIG. 2 is a rear elevational view thereof.
Figure 3:
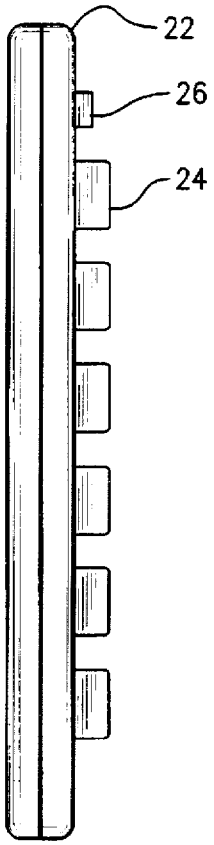
FIG. 3 is a left side elevational view thereof.
Figure 4:
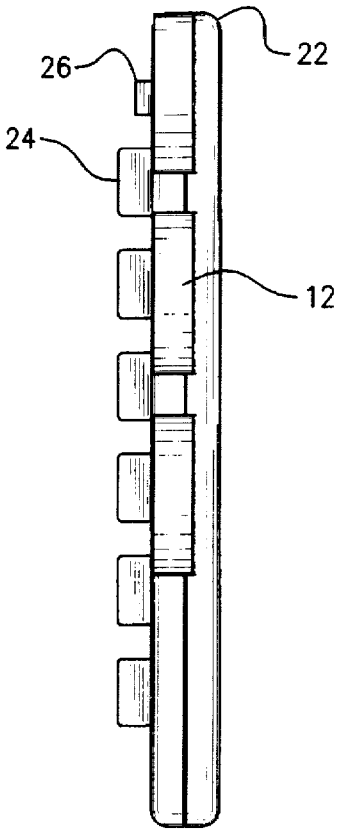
FIG. 4 is a right side elevational view thereof.
Figure 5:
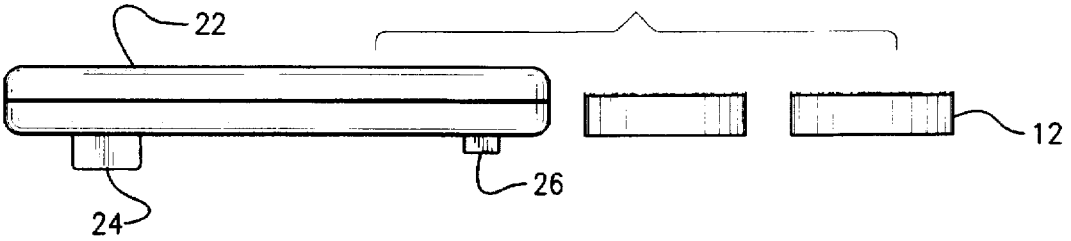
FIG. 5 is a top plan view thereof.
Figure 6:
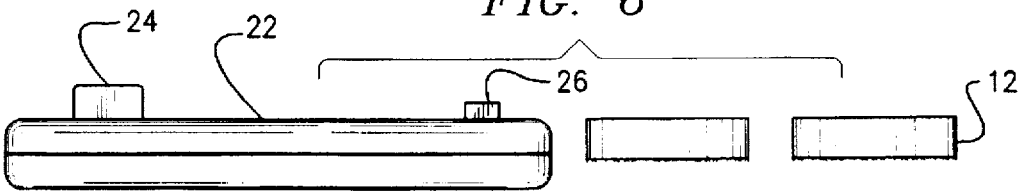
FIG. 6 is a bottom plan view thereof.
Figure 7:
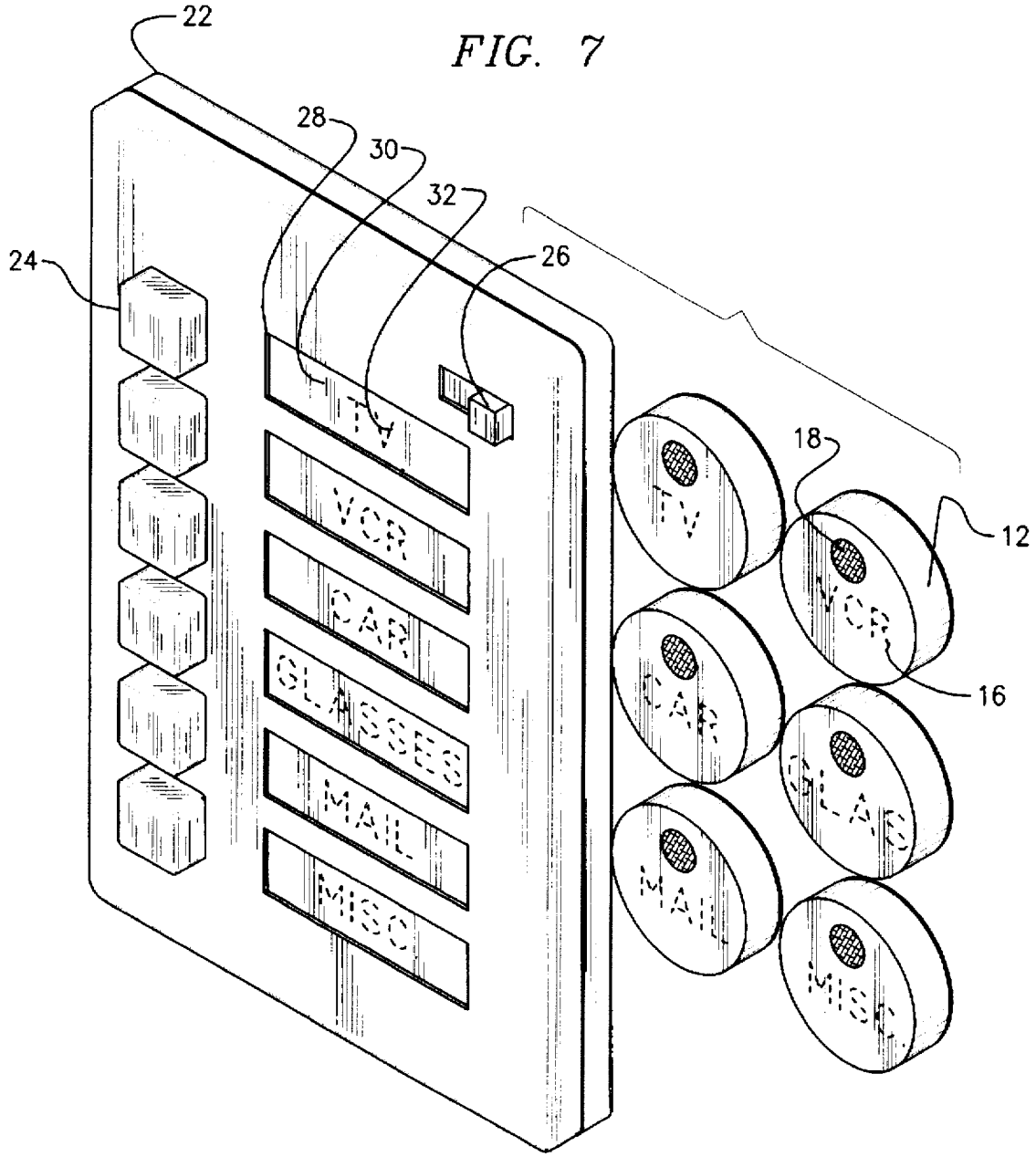
FIG. 7 is an isometric view thereof.
Figure 8:
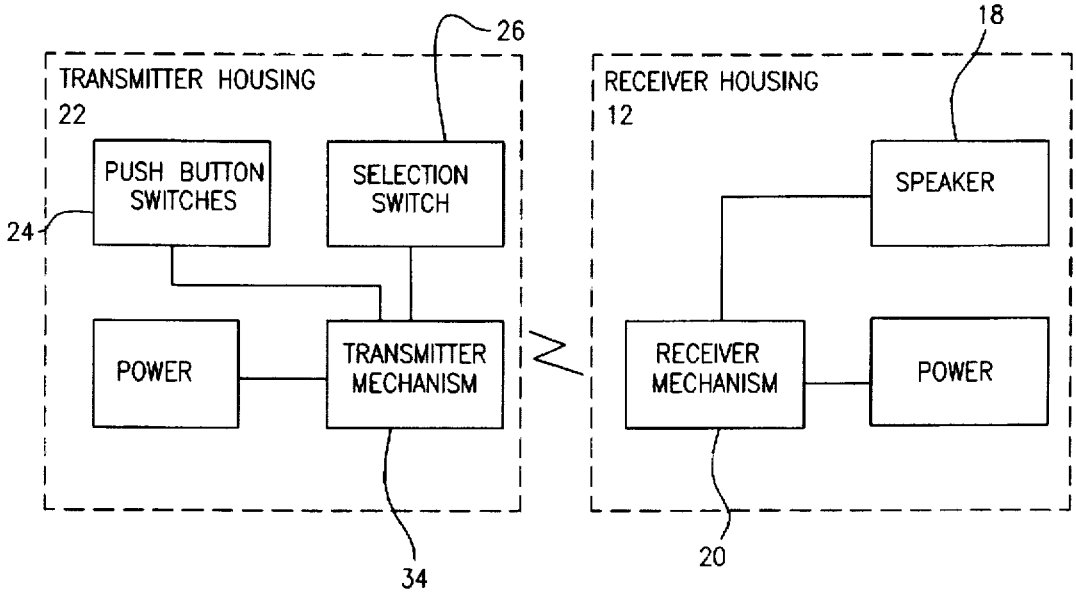
FIG. 8 is a schematic diagram depicting the interconnection of the electrical components employed in the present invention.

With reference now to the drawings, and in particular to FIG. 1 thereof, a new and improved apparatus for locating a plurality of objects embodying the principles and concepts of the present invention and generally designated by the reference numeral 10 will be described.

The present invention, the new and improved apparatus for locating a plurality of objects, is comprised of a plurality of components. Such components in their broadest context include a plurality of receiver units and transmitter unit. Such components are individually configured and correlated with respect to each other so as to attain the desired objective.

More specifically, it will be noted that the system 10 of the present invention includes a plurality of receiver units each including a disk-shaped receiver housing 12. Each receiver housing has a first pile fastener 14 secured to a bottom surface thereof for allowing coupling with a second pile fastener situated on an entity. Such an entity may include tools, keys, eye glass cases, remote controls, wallet, or the like. Alternatively, other forms of couplings may be employed to attach the receiver unit to a child. For identification purposes, indicia 16 indicative of the entity attached to the receiver housing or the corresponding push button is imprinted on a top surface thereof.

Also included is a speaker 18 situated on the top surface of the receiver housing for transmitting an audio signal. The speaker preferably comprises of a small beeper in order to afford maximum energy efficiency.

A receiver mechanism 20 is situated within the receiver housing and connected to the speaker. The receiver mechanism of each receiver unit is adapted to transmit a unique audio signal via the speaker thereof upon the receipt of a unique activation signal.

The second major component of the present invention is a transmitter unit comprising a transmitter housing 22 with a generally rectangular configuration. The transmitter housing has a front face, a rear face, and a periphery formed therebetween defining an interior space. The housing is suitably attached to an associated recipient surface such as wall via any one of a plurality of well-known mounting methods. The transmitter unit could also be powered by household current.

Situated on the front face of the housing are a plurality of push button switches 24 orientated in a linearly aligned vertical configuration adjacent to the periphery thereof. Each push button is adapted to actuate upon the depression thereof. Further included is a single throw double pole selection switch 26 situated on the front face of the housing. In use, the selection switch has a first orientation and a second orientation.

A plurality of transparent sleeves 28 are each positioned on the front face of the housing adjacent to a corresponding push button switch. For inserting within each of the transparent sleeves, a plurality of labels 30 comprising a slip of paper are included with indicia 32 indicative of an entity imprinted thereon.

Finally, a transmitter mechanism 34 is situated within the transmitter housing and coupled to the push button switches and selection switch. When the selection switch is in the first orientation thereof, the transmitter mechanism is adapted to transmit a unique activation signal corresponding to a receiver unit upon the continuous depression of a corresponding push button switch. In such a mode of operation, one of the receiver units transmits a unique audio signal solely while the push button switch is depressed. In another mode of operation wherein the selection switch is in the second orientation thereof, the transmitter mechanism is adapted to transmit a sustained unique activation signal corresponding to a receiver unit upon a first depression of a corresponding push button switch. Also in this mode, the user may effect cessation of the sustained activation signal by depressing a second time the corresponding push button switch. In the latter mode of operation, one of the receiver units transmits a continuous unique audio signal without the need for a user to continuously depress the corresponding push button switch.

Figure 9:
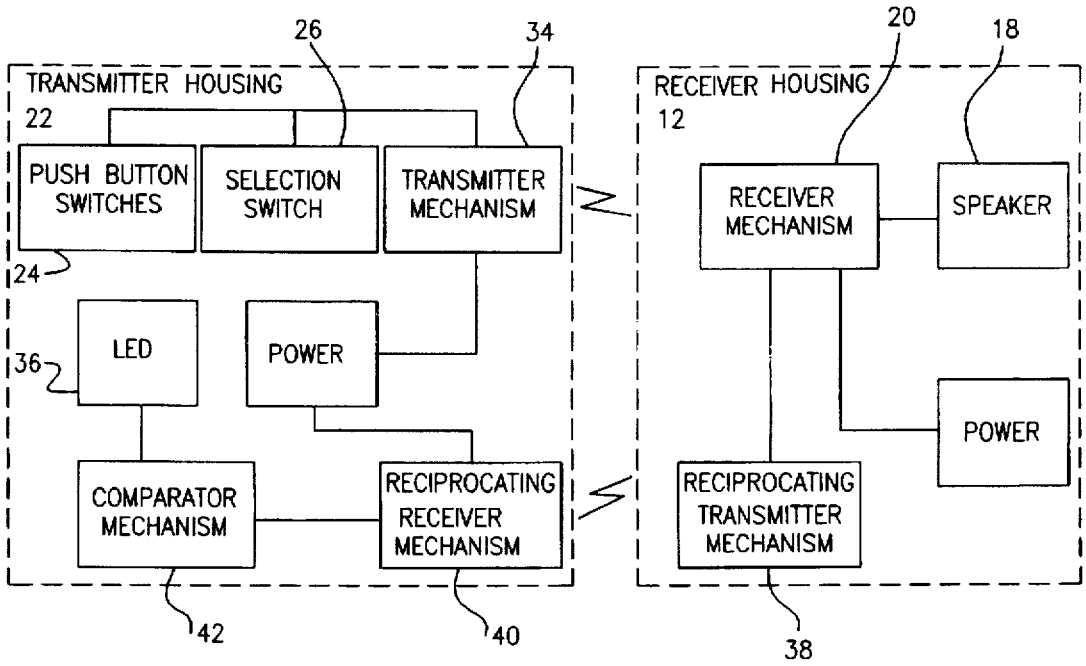
FIG. 9 is a schematic diagram depicting the interconnection of the electrical components employed in the alternate embodiment.

In an alternate embodiment, as best shown in FIG. 9, the transmitter takes the form of a portable unit. The transmitter, in the present embodiment, is adapted to continuously transmit an activation signal intermittently upon the activation thereof. In addition to the foregoing components, the alternate embodiment may include a light emitting diode 36 situated on the front face of the transmitter housing and adapted to light upon the activation thereof. Also included is a reciprocating transmitter mechanism 38 situated within the receiver housing and connected to the receiver mechanism of the receiver unit. The reciprocating transmitter is adapted to immediately transmit a responding signal upon the receipt of the activation signal via the receiver mechanism 20. A reciprocating receiver mechanism 40 is situated within the transmitter housing and adapted to provide a calculation signal upon the receipt of the responding signal from the reciprocating transmitter mechanism. A comparator mechanism 42 is situated within the transmitter housing and is connected to the transmitter mechanism, reciprocating receiver mechanism, and light emitting diode. The comparator mechanism is adapted to gauge the length of time between the transmission of the activation signal and the receipt of the calculation signal. Upon such calculation, the light emitting diode is intermittently activated at a rate which is a function of the gauged length of time. Preferably, the rate is designed to increase upon the measurement of a decrease in time thus ultimately increasing the rate of the intermittent activation of the diode when transporting the transmitter unit closer to the receiver unit.

The present invention affords a novel method of locating items lost or misplaced. By employing two modes of operation in the primary embodiment, the present device allows a user to merely effect an instantaneous audio signal for quick recovery of a missing item or a continuous audio signal for allowing a lengthy search. Also, in the alternate embodiment, the present invention employs a unique system including a light emitting diode which indicates the proximity of the missing entity. Such a feature is especially beneficial at a beach, playground, or the like where the lost item may be concealed or the audio signal thereof is muffled.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved apparatus for locating a plurality of objects comprising, in combination:

a plurality of receiver units each including:

a disk-shaped receiver housing with a first pile fastener secured to a bottom surface thereof for allowing coupling with a second pile fastener situated on an entity, indicia indicative of the entity imprinted on a top surface of the receiver housing;

a speaker situated on the top surface of the receiver housing for transmitting an audio signal, and a receiver means situated within the receiver housing and connected to the speaker, the receiver mechanism of each receiver unit adapted to transmit a unique audio signal via the speaker thereof upon the receipt of a unique activation signal; and a transmitter unit comprising:

a transmitter housing with generally rectangular configuration having a front face, a rear face, and a periphery formed therebetween defining an interior space, a plurality of push button switches situated on the front face of the housing in a linearly aligned vertical configuration adjacent to the periphery thereof, each push button adapted to actuate upon the depression thereof, a single throw double pole selection switch situated on the front face of the housing, the selection switch having a first orientation and a second orientation, a plurality of transparent sleeves each positioned on the front face of the housing adjacent to a corresponding push button switch, a plurality of labels comprising a slip of paper with indicia indicative of one the entities, each label adapted to be slidably inserted within one of the transparent sleeves so as to effect identification of the corresponding push button switch, and a transmitter means situated within the transmitter housing and coupled to the push button switches and selection switch, the transmitter means adapted to transmit a unique activation signal corresponding to one of the receiver units upon the continuous depression of a corresponding push button switch with the selection switch in a first orientation whereby one of the receiver units transmits a unique audio signal solely while the push button switch is depressed, the transmitter means further adapted to transmit a sustained unique activation signal corresponding to one of the receiver units upon a first depression of a corresponding push button switch with the selection switch in a second orientation and further allow the cessation of the sustained activation signal upon the second depression thereof whereby a receiver unit transmits a continuous unique audio signal without the need for a user to continuously depress the corresponding push button switch.

2. An apparatus for locating a plurality of objects comprising:

a plurality of receiver units each including:

a receiver housing with a first pile fastener secured to a bottom surface thereof for allowing coupling with a second pile fastener situated on an entity, a speaker situated on the top surface of the receiver housing for transmitting an audio signal, and a receiver means situated within the receiver housing and connected to the speaker, the receiver of each receiver unit adapted to transmit a unique audio signal via the speaker thereof upon the receipt of a unique activation signal;

a transmitter unit comprising:

a transmitter housing having a front face, a rear face, and a periphery formed therebetween defining an interior space, a plurality of push button switches situated on the front face of the housing, each push button adapted to actuate upon the depression thereof, a transmitter means situated within the transmitter housing and coupled to the push button switches, the transmitter means adapted to transmit a unique activation signal corresponding to one of the receiver units upon the continuous depression of a corresponding push button switch whereby one of the receiver units transmits a unique audio signal solely while the push button switch is depressed; and a single throw double pole selection switch situated on the front face of the housing, the selection switch having a first orientation and a second orientation, wherein the transmitter means is adapted to transmit a unique activation signal corresponding to one of the receiver units upon the continuous depression of a corresponding push button switch with the selection switch in a first orientation whereby one of the receiver units transmits a unique audio signal solely while the push button switch is depressed and the transmitter means is further adapted to transmit a sustained unique activation signal corresponding to one of the receiver units upon a first depression of a corresponding push button switch with the selection switch in a second orientation and further allow the cessation of the sustained activation signal upon the second depression thereof whereby a receiver unit transmits a continuous unique audio signal without the need for a user to continuously depress the corresponding push button switch.

3. An apparatus for locating a plurality of objects comprising:

a plurality of receiver units each including:

a receiver housing with a first pile fastener secured to a bottom surface thereof for allowing coupling with a second pile fastener situated on an entity, a speaker situated on the top surface of the receiver housing for transmitting an audio signal, and a receiver means situated within the receiver housing and connected to the speaker, the receiver of each receiver unit adapted to transmit a unique audio signal via the speaker thereof upon the receipt of a unique activation signal;

a transmitter unit comprising:

a transmitter housing having a front face, a rear face, and a periphery formed therebetween defining an interior space, a plurality of push button switches situated on the front face of the housing, each push button adapted to actuate upon the depression thereof, and a transmitter means situated within the transmitter housing and coupled to the push button switches, the transmitter means adapted to transmit a unique activation signal corresponding to one of the receiver units upon the continuous depression of a corresponding push button switch whereby one of the receiver units transmits a unique audio signal solely while the push button switch is depressed;

wherein the transmitter unit is a portable unit which transmits the activation signal intermittently;

a light emitting diode situated on the front face of the transmitter housing and adapted to light upon the activation thereof;

a reciprocating transmitter means situated within the receiver housing and connected to the receiver means, the reciprocating transmitter adapted to immediately transmit a responding signal upon the receipt of the activation signal;

a reciprocating receiver means situated within the transmitter housing and adapted to provide a calculation signal upon the receipt of the responding signal from the reciprocating transmitter means; and a comparator means situated within the transmitter housing and connected to the transmitter means, reciprocating receiver means, and light emitting diode, the comparator means adapted gauge the length of time between the transmission of the activation signal and the receipt of the calculation signal and further intermittently activate the light emitting diode at a rate dependent on the gauged length of time.

* * * * *